US006606997B2

(12) United States Patent
Brue

(10) Patent No.: US 6,606,997 B2
(45) Date of Patent: Aug. 19, 2003

(54) SMOKING CESSATION APPARATUS AND METHOD

(76) Inventor: Vesta L. Brue, 2635 Puesta Del Sol, Santa Barbara, CA (US) 93105

( * ) Notice: Subject to any disclaimer, the term of this patent is extended or adjusted under 35 U.S.C. 154(b) by 0 days.

(21) Appl. No.: 09/782,592

(22) Filed: Feb. 12, 2001

(65) Prior Publication Data

US 2001/0027794 A1 Oct. 11, 2001

Related U.S. Application Data

(63) Continuation-in-part of application No. 29/080,096, filed on Dec. 1, 1997, now Pat. No. Des. 440,352.

(51) Int. Cl.[7] ..... A24F 47/00
(52) U.S. Cl. ..... 131/270; 131/328
(58) Field of Search ..... 131/270, 329, 131/328; 206/242, 259, 265; D27/172, 183, 186, 187, 189

(56) References Cited

U.S. PATENT DOCUMENTS 2,613,527 A * 10/1952 Harris ..... 131/231
3,861,523 A * 1/1975 Fountain et al. ..... 131/270
3,963,033 A * 6/1976 Pope ..... 131/270
4,037,719 A * 7/1977 Perlmutter ..... 116/314
4,076,118 A * 2/1978 Karlsson ..... 131/270
4,615,681 A * 10/1986 Schwarz ..... 131/270
4,620,555 A * 11/1986 Schwarz ..... 131/270
4,862,431 A * 8/1989 Drouin ..... 131/270
5,217,379 A * 6/1993 Kirschenbaum et al. .... 131/270
6,125,082 A * 9/2000 Reid ..... 131/270

* cited by examiner

*Primary Examiner*—Steven P. Griffin
*Assistant Examiner*—Carlos Lopez
(74) *Attorney, Agent, or Firm*—Sidley Austin Brown & Wood LLP

(57) ABSTRACT

A habit cessation apparatus which can be used in a method for diminution or cessation of smoking or other habits is provided which collects data on a given users habits passively and provides a scheduled diminution program implemented by communication means such as displays, lights and/or audible cues.

22 Claims, 3 Drawing Sheets

SMOKING CESSATION APPARATUS AND METHOD

CROSS-REFERENCE TO RELATED APPLICATIONS

The applicant for this non-provisional continuation-in-part utility application hereby claims priority based on the prior design application HABIT CESSATION DEVICE filed on Dec. 1, 1997 and assigned application Ser. No. 29/080,096 now U.S. Pat. No. D 440352.

FIELD OF THE INVENTION

This invention pertains to the field of devices for use in smoking cessation.

BACKGROUND OF THE INVENTION

Smoking cigarettes is a habit prevalent among the United States population. Although cigarette packs are printed with warnings concerning the possible health risks of smoking, laws have been passed to confine smokers to particular public areas, and aversion to second hand smoke has been made well-known through a great amount of publicity, many people who want to quit smoking for health and aesthetic reasons still find themselves unable to do so.

Several approaches to assist a smoker in quitting smoking are in common use. In the "cold turkey" method, the smoker ceases smoking at a given time. Over 88% of former smokers report having tried unsuccessfully to quit smoking using the cold turkey method of smoking cessation (Fiore, et al. 1990. "Methods used to quit smoking in the United States. Do cessation programs help?" *J Am Med Assoc* 263:276–2765). The nicotine patch serves as a transdermal nicotine delivery system to provide the nicotine drug to a person under the theory that smoking can be reduced or eliminated if the addictive component of the cigarette is provided to the bloodstream through a mechanism other than inhaling the nicotine-bearing smoke which contains over 4,000 chemicals and toxins. Another approach is utilizing nicotine gum, inhalers or sublingual tablets; again, mechanisms of nicotine delivery other than through smoking. Other methods have employed acupuncture, hypnosis, and prescription drugs.

Despite the availability of these smoking cessation aids, the success rate among motivated smokers to quit smoking is very low, approximating 7%. Because addiction or perceived addiction to cigarette smoking is not susceptible to a magic bullet or successful for all those that wish to quit permanently, several authors have suggested that behavioral modification techniques could be helpful. One behavioral modification method is a self-administered gradual reduction of smoking.

Several methods and/or devices have been used to achieve a gradual reduced smoking regimen. In the early 1970's, timed prompts and audible cues to alert a smoker as to the next permitted smoke were employed to instruct subjects when to smoke. (Shapiro et al. 1971. "Smoking on cue. A behavioral approach to smoking reduction," *J Health Social Behavior* 12: 108–113, Bernard, H. S. and Efron, J. A. 1972. "Eliminating versus reducing smoking using pocket timers," *Behavior Research Therapy* 10:39–41). While some studies reported use of such self-administered controlled smoking devices resulted in significant decreases in average cigarette consumption, there were significant problems associated with their use. Reduction methods are commonly compromised when smokers control the timing of their cigarettes, eliminate only lowest priority cigarettes, maintain the reinforcing effects of nicotine in highly rewarding associations, and fail to exercise coping skills when confronted with usual smoking cues.

Use of computer-assisted smoking cessation scheduling protocols has been facilitated by palm-held microcomputers delivering timed alerts over ever-increasing intervals. Such programs require smokers who manually registered each smoking event. Various protocols in use serve as a systematic pacer to step-down tobacco consumption. As nicotine fades, the smoker adjusts to longer spans between cigarettes and, presumably, practices coping skills to better tolerate withdrawal. Benefits of this type of method and/or device include reductions in withdrawal symptoms, frequency of urges, frequency and severity of negative affect, and side effects. Conversely, increases in self-efficacy and effectiveness of coping behaviors seemed to contribute to more positive outcomes.

A method and device have now been found which provides not only a passive means of recording and time-stamping, smoking events (measuring cigarettes smoked) but also a means by which scheduled plans for diminution in smoking can be calculated, critical changes in the smoking schedule can be made and the schedule communicated to the user. The user need not actively provide data to the device which provides for greater accuracy and compliance. The device and method can also be used for the diminution or cessation of other habit-forming substances.

SUMMARY OF THE INVENTION

In one aspect, the invention is a habit cessation device comprising a case body and a lid. Changing the position of the lid from a first closed position to a second opened position actuates a sensor which provides data on time of day the lid is opened to a data collection unit in said device that tallies the number of lid openings for each day. Electronics in the device provide a schedule for consumption of a habit forming substance stored in said device and communicates a signal designating when the next use of the habit forming substance is permitted.

In another aspect, the invention includes a method for the diminution or cessation of smoking by using a habit cessation device with particular attributes.

DETAILED DESCRIPTION

A habit cessation device is disclosed which is useful in a method for cessation or diminution of smoking by behavioral modification techniques. The device is designed to hold a habit-forming substance, such as tobacco products which the user wishes to cease using over time. In a preferred embodiment, the device is designed to hold one package of cigarettes. The device functions on the basis of passive activity by the user. That is, upon engaging in the normal activity of removing a habit-forming substance from the case such as a cigarette, the act of lid opening is detected by a lid-opening sensor which then sends a signal to a data collection unit contained in the device which is capable of collecting and storing data. Based on actuations of the lid-opening sensor during a fixed time period, the unit will collect data. At the conclusion of pre-selected fixed time period, a data analysis means embedded in the device will apply an algorithm to the collected data, and provide a schedule to the user for permitted removal of a habit-forming substance from said device. The schedule will be communicated to the user via a communication means, such as an audible sound, a light, and for a display means such as a numerical count down time to the next permitted removal. Optionally, the data collected may be transmitted via telephone computer modem or wireless transmission to a remote server which can analyze said data and transmit a behavior schedule to the device for subsequent communication to the user. Preferably, a display means will show the user how many cigarettes have been removed from the habit cessation device, a number assumed to be equal to the number actuations of the lid-opening sensor, and display this number.

Figure 3:
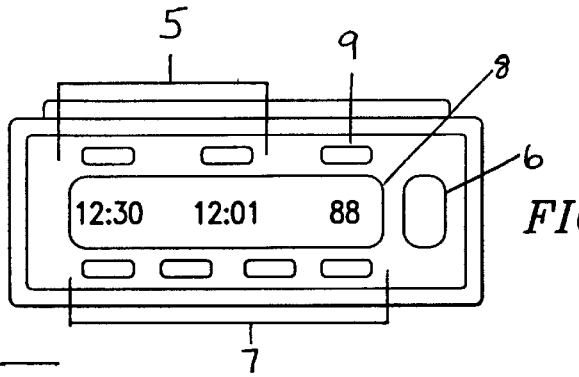
FIG. 3 is a top plan view thereof.
Figure 1:
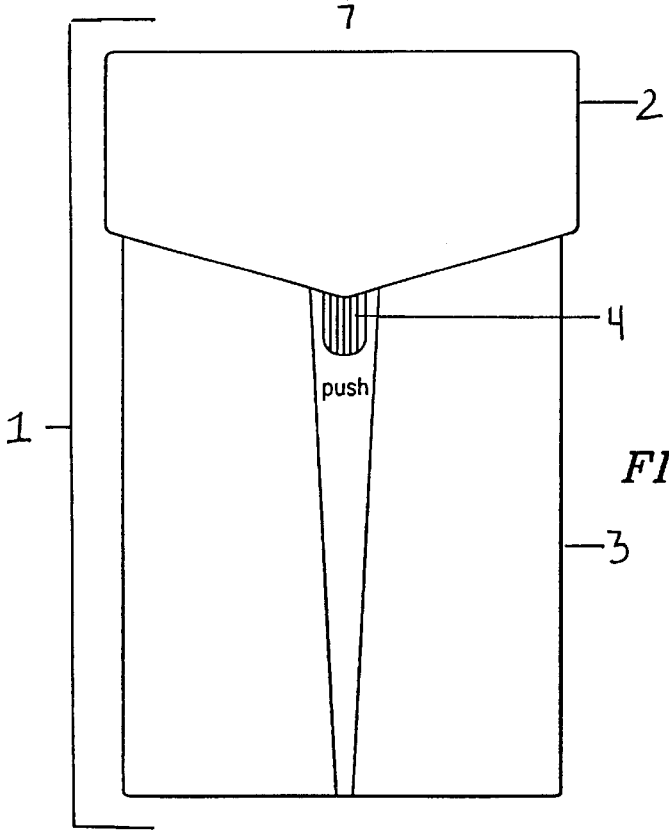
FIG. 1 is a front plan view of a habit cessation device.
Figure 2:
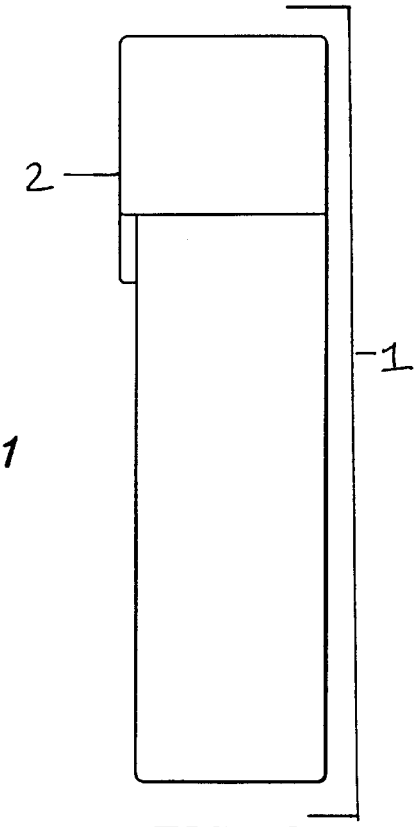
FIG. 2 is a side plan view thereof.
Figure 4:
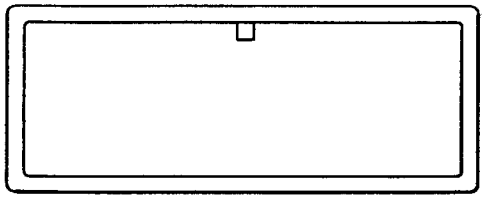
FIG. 4 is a bottom plan view thereof.
Figure 5:
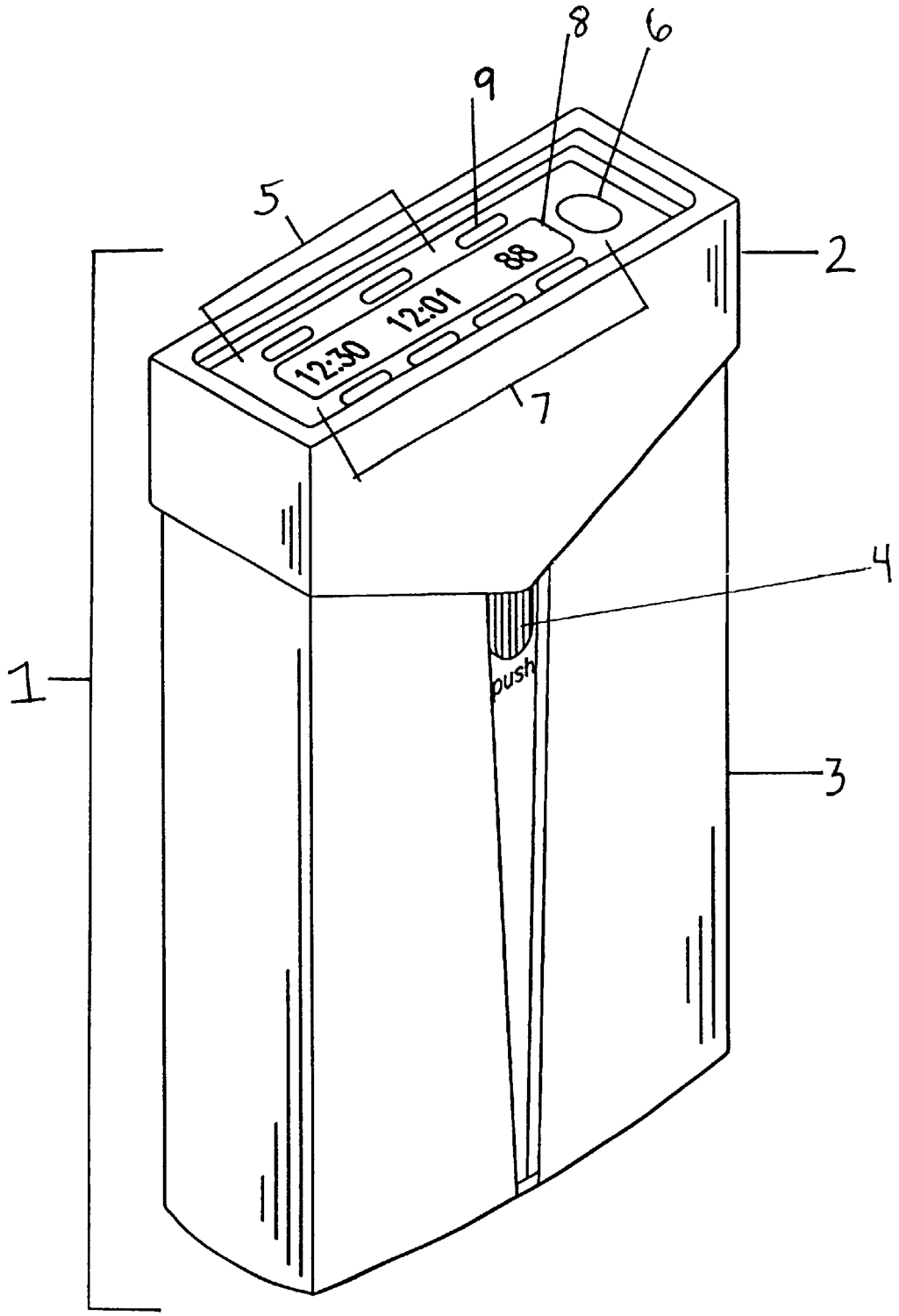
FIG. 5 is a perspective view thereof.

In addition to the lid-opening sensor, the device may be equipped with a number of input interface buttons (7) which are best seen in FIG. 5. Although the number of input interface buttons may vary depending on the needs of the user, and the regimen employed by the user, the data collection unit may be programmed to collect additional behavioral data depending on which input button is actuated by the user. In another embodiment, no user input buttons are provided to the device.

The device may be provided with additional buttons (5) as best seen in FIG. 5 which permit the user to set the time of day, to reset the device and a regimen for a new user, to mute any sound which the device may emit, to undo a mistaken operation and/or to backlight the LCD display. Preferably, the device is provided with speaker (6) which will emit an audible signal when the user is permitted to open the container to retrieve a habit-forming substance according to the behavior modification schedule. Preferably, the case houses a light emitting device (LED) which will blink repeatedly when the user is permitted to open the case to consume the habit forming substance. In the case of a device provided with speaker (6) it is most preferred that one of buttons (5) is a volume control or mute button to control or suppress the sound. Alternatively, the device contains no user-actuated, reset buttons. In such case, the device may include reset means actuable by a remote smoking cessation monitor or physician such as at a smoking cessation clinic. In yet another embodiment, an LCD (liquid crystal) display (8) is activated by initiating current or by pushing a start button. In such case, the device's LCD visually displays information useful in the habit cessation method. For example, the device may be set to display the number of lid actuations equivalent to the number of cigarettes smoked and the time to the next scheduled cigarette.

Now turning to FIG. 5, a habit cessation device (1) comprising case body (3) and lid (2) is shown in a lid closed position. A latch release button (4) is provided which allows a user to move lid (2) from a first position closed to a second opened position which activates the sensor. Case body (3) is adapted to hold the habit-forming substance to be monitored such as a pack of cigarettes. It is contemplated that the dimensions of the device can be altered to accommodate other habit-forming substances such as cigars, smokeless tobacco, or any other substance the user wishes to control the habitual consumption or use of Such substances may include foods, cosmetics, pharmaceutics and oral pacification devices such as pacifiers, toothpicks or any other substance habitually used by a user. User input button (7) may optionally be provided so that the user may input certain programmed data into the device. Buttons (5) may optionally be provided so that the user may change the time of day, backlight the LCD display and/or mute the sound or provide another function. LED blinking light (9) may optionally be provided to signal the user. Liquid Crystal Display (LCD) display (8) preferably provides information to the user such as current time of day, time to next cigarette, and number of cigarettes smoked per day.

Figure 6:
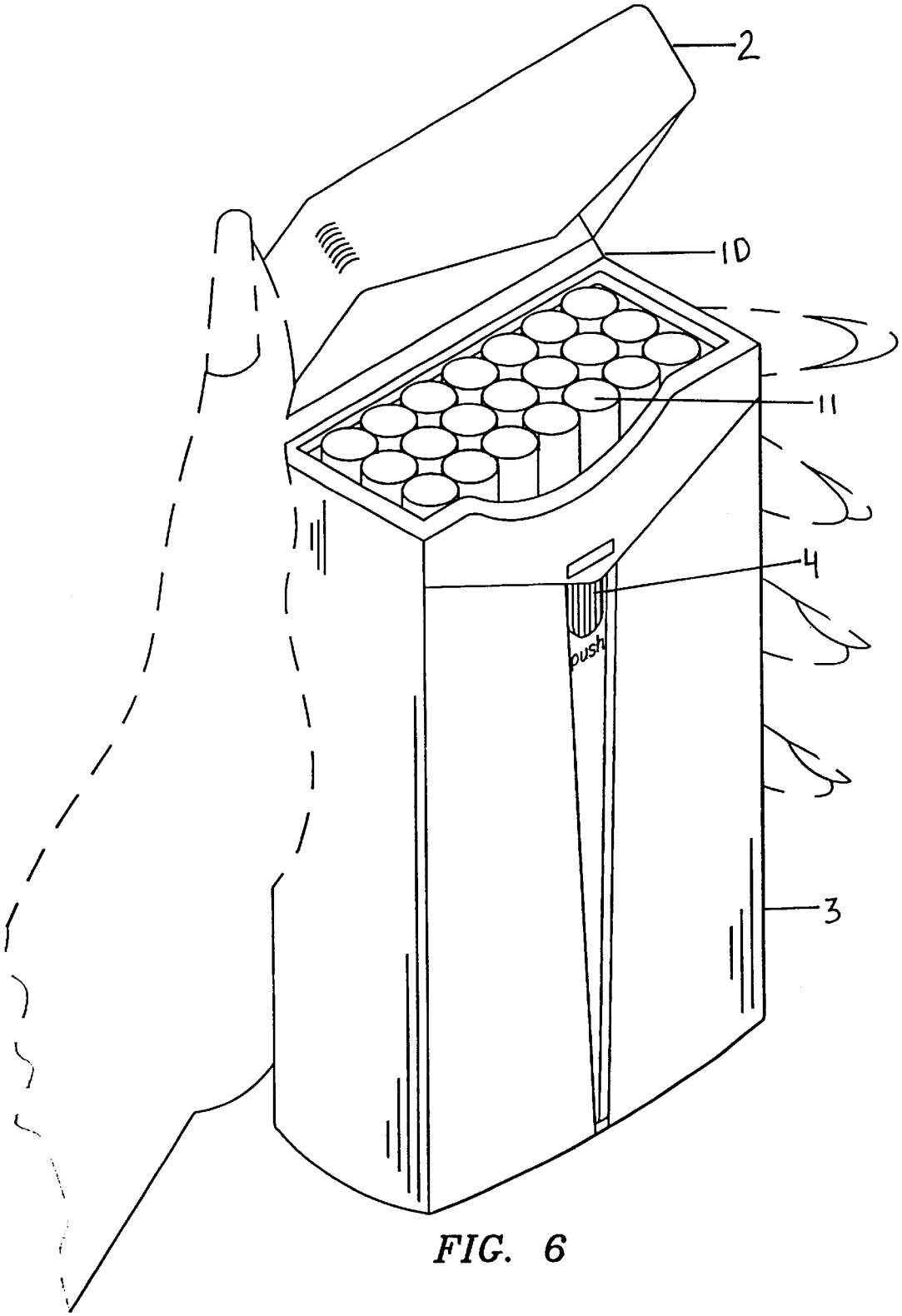
FIG. 6 is another perspective view of the habit cessation device being opened by a user thereof.

As best seen in FIG. 6, the habit cessation device is shown in its second opened lid position. In said opened lid position hinge (10) is visible as are cigarettes (11) contained in body (3). In operation, the user presses button (4), thus releasing the lid and actuating a signal to a data collection unit preferably housed in lid (2) but which can also be located in body (3). The unit may be powered by a battery such as a standard AAA alkaline battery or any alternative power source capable of providing sufficient power to the data collection unit.

I claim:

1. A habit cessation device useful for the diminution or cessation of consumption or use of a habit-forming substance comprising a case body dimensioned to contain said habit-forming substance, a lid which removably engages with said case body, a lid actuation device which provides a signal upon change of position of said lid from a first closed position to a second opened position to a data collection unit integrated in said habit cessation device, said signal indicating the time of day said change of position of said lid from a first closed position to a second opened position occurs and said data collection unit recording the number of lid openings over time, and a communication means which provides a user of said habit-forming substance with a perceivable schedule for use of said habit-forming substance.

2. The habit cessation device of claim 1, further comprising a data analysis portion which analyzes data from a plurality of said signals gathered over time and calculates a custom schedule communicable to a user via said communication means.

3. The habit cessation device of claim 1 or 2, wherein said communication means is an LCD display which provides a countdown time for cued consumption of said habit forming substance.

4. The habit cessation device of claim 1 or 2, wherein said communication means is a light which periodically illuminates coincident with the time for scheduled consumption of said habit forming substance.

5. The habit cessation device of claim 1 or 2, wherein said communication means is a sound-producing electronic and a speaker emitting sound produced thereby, said sound-producing electronic producing a sound coincident with the time for usage of said habit forming substance.

6. The habit cessation device of claim 1 or 2, wherein said lid is attached to said case body by an integral hinge.

7. The habit cessation device of claim 1 or 2, further comprising a latch release button which may be depressed to permit said lid to be moved from said first closed position to said second opened position.

8. The habit cessation device of claim 1 or 2, wherein said case body is dimensioned to contain a pack of cigarettes.

9. A passive method of diminution or cessation of use of a habit-forming substance, comprising utilizing a habit cessation device useful for the diminution or cessation of consumption or use of a habit-forming substance comprising a case body dimensioned to contain said habit-forming substance, a lid which removably engages with said case body, a lid actuation device which provides a signal upon change of position of said lid from a first closed position to a second opened position to a data collection unit integrated in said habit cessation device, said signal indicating the time of day said change of position of said lid from a first closed position to a second opened position occurs and said data collection unit recording the number of lid openings over time, and a communication means which provides a user of said habit-forming substance with a perceivable schedule for use of said habit-forming substance in a protocol for scheduled gradual diminution over time of said use of habit-forming substance.

10. A passive method of diminution or cessation of use of a habit-forming substance, of claim 9, wherein said communication means is an LCD display which provides a countdown time for cued consumption of said habit forming substance in a protocol for scheduled gradual diminution over time of said use of said habit-forming substance.

11. A passive method of diminution or cessation of use of a habit-forming substance, according to claim 9, wherein said communication means is a light which periodically illuminates coincident with the time for scheduled consumption of said habit forming substance.

12. A passive method of diminution or cessation of use of a habit-forming substance, according to claim 9, wherein said communication means is a sound-producing electronic and a speaker emitting sound produced thereby, said sound-producing electronic producing a sound coincident with the time for usage of said habit forming substance.

13. A passive method of diminution or cessation of use of a habit-forming substance, according to claim 9, wherein said lid of said habit cessation device is attached to said case body by an integral hinge.

14. A passive method of diminution or cessation of use of a habit-forming substance, according to claim 9, wherein said habit cessation device further comprises a latch release button which may be depressed to permit said lid to be moved from said first closed position to said second opened position.

15. A passive method of diminution or cessation of use of a habit-forming substance, according to claim 9, wherein said habit cessation device is dimensioned to contain a pack of cigarettes.

16. A passive method of diminution or cessation of use of a habit-forming substance, comprising utilizing a habit cessation device useful for the diminution or cessation of consumption or use of a habit-forming substance comprising a case body dimensioned to contain said habit-forming substance, a lid which removably engages with said case body, a lid actuation device which provides a signal upon change of position of said lid from a first closed position to a second opened position to a data collection unit integrated in said habit cessation device, said signal indicating the time of day said change of position of said lid from a first closed position to a second opened position occurs and said data collection unit recording the number of lid openings over time, a communication means which provides a user of said habit-forming substance with a perceivable schedule for use of said habit-forming substance device, and a data analysis portion which analyzes data from a plurality of said signals gathered over time and calculates a custom schedule communicable to a user via said communication means in a protocol for scheduled gradual diminution over time of said use of said habit-forming substance.

17. A passive method of diminution or cessation of use of a habit-forming substance, of claim 16, wherein said communication means is an LCD display which provides a countdown time for cued consumption of said habit forming substance in a protocol for scheduled gradual diminution over time of said use of said habit-forming substance.

18. A passive method of diminution or cessation of use of a habit-forming substance, according to claim 16, wherein said communication means is a light which periodically illuminates coincident with the time for scheduled consumption of said habit forming substance.

19. A passive method of diminution or cessation of use of a habit-forming substance, according to claim 16, wherein said communication means is a sound-producing electronic and a speaker emitting sound produced thereby, said sound-producing electronic producing a sound coincident with the time for usage of said habit forming substance.

20. A passive method of diminution or cessation of use of a habit-forming substance, according to claim 16, wherein said lid of said habit cessation device is attached to said case body by an integral hinge.

21. A passive method of diminution or cessation of use of a habit-forming substance, according to claim 16, wherein said habit cessation device further comprises a latch release button which may be depressed to permit said lid to be moved from said first closed position to said second opened position.

22. A passive method of diminution or cessation of use of a habit-forming substance, according to claim 16, wherein said habit cessation device is dimensioned to contain a pack of cigarettes.

* * * * *